US006381929B1

(12) United States Patent
Chen

(10) Patent No.: US 6,381,929 B1
(45) Date of Patent: May 7, 2002

(54) AUTOMATIC BAGGING MACHINE USING COOL-SHRINKING FILM

(75) Inventor: Tuan-Mei Chiu Chen, Chia Yi Hsien (TW)

(73) Assignee: Tien Heng Machinery Co., Ltd., Chia Yi Hsien (TW)

( * ) Notice: Subject to any disclaimer, the term of this patent is extended or adjusted under 35 U.S.C. 154(b) by 0 days.

(21) Appl. No.: 09/524,908

(22) Filed: Mar. 14, 2000

(51) Int. Cl.[7] ..... B65B 9/10

(52) U.S. Cl. ..... 53/567; 53/441; 53/556; 53/570; 53/585; 53/591

(58) Field of Search ..... 53/567, 570, 582, 53/583, 585, 589, 590, 591, 390, 441, 556

(56) References Cited

U.S. PATENT DOCUMENTS 3,577,704 A * 5/1971 Lense ..... 53/386.1
3,778,960 A * 12/1973 Christensen et al. ..... 53/386.1
3,897,674 A * 8/1975 Higgins ..... 53/567
4,050,219 A * 9/1977 Higgins ..... 53/567
4,063,401 A * 12/1977 Higgins ..... 53/567
4,064,678 A * 12/1977 Grocke ..... 53/384.1
4,401,020 A * 8/1983 Brux ..... 100/6
4,480,536 A * 11/1984 Burns ..... 100/6
4,537,013 A * 8/1985 Tetenborg et al. ..... 141/114
4,537,015 A * 8/1985 Inglett et al. ..... 493/313

* cited by examiner

*Primary Examiner*—Rinaldi I. Rada
*Assistant Examiner*—Christopher Harmon
(74) *Attorney, Agent, or Firm*—Rosenberg, Klein & Lee

(57) ABSTRACT

An automatic bagging machine using cool-shrinking film includes mainly a machine body, a bag conveying device, a bag sealing device, a bag sucking device, and a bag supporting device combined on the machine body. The bag conveying device sends continual bags to the bag sucking device to suck and stick to a lower opening of each bag to open it for a first stage. Then the four corners of the opening of the bag are respectively sucked to stick to suck drums fixed with air suckers by operation of position air pressure cylinders beside each air sucker. Then the bag is expanded out to a preset medium size, not falling down during expanding process. Next, the bag supporting device continually sends out a certain length of the bag to be positioned in the bag supporting device, which then expands the bag again to a preset maximum size. The bag together with the bag supporting device are lowered down by elevating frames to release the bag to cover and surround products (or cartons) together with the storing plate. After the bag is completely set free by the bag supporting device, then the lower opening is closed up to tightly cover and surround the products and the storing plate together. The automatic bagging machine can surely bag products and a storing plate in each round of bagging.

10 Claims, 18 Drawing Sheets

AUTOMATIC BAGGING MACHINE USING COOL-SHRINKING FILM

BACKGROUND OF THE INVENTION

This invention relates to an automatic bagging machine using cool-shrinking film, particularly to one including a bag sucking device and a bag supporting device for surely bagging products and a storing plate together with a cool-shrinking film bag, which does not fall down during bagging process.

Generally products of common factories are packaged in cartons, and then a number of cartons are piled up on a storing plate and then bagging the cartons together with the storing plate with a kind of shrinkable bag, in view of saving cost for transportation and convenience. The shrinkable 15 bags are then cooled by blowing air against them to shrink and surround the cartons and the storing plate together tightly not to let the cartons fall and scatter around, and at the same time piling a large number of cartons on the storing plate as possible. At present, bagging work is performed by an automatic bagging machine to reduce wages for workers in a great degree.

A known conventional automatic bagging machine shown in FIG. 19, includes a machine body 10, on which a bag conveying device 20 a bag sealing device 30 a bag supporting device 40 and a driving device 50 are installed. The bag conveying device 20 sends bags to the bag sealing device 30. which has air suckers 301 to suck the two sides of a lower opening of a bag to open wide for support rods 401 of the supporting device 40 to extend into four corners of a bag and expand it outward. Then an elevator 402 of the supporting device 40 lowers the four support rods 401 and the bag expanded to surround outer sides of the cartons and the storing plate and then sealed the opening of the bag by the sealing device 30. finishing bagging process once. Then the machine waits for next bagging operation. However, the known conventional bagging machine has an disadvantage that the air suckers 301 not always correctly suck and stick accurately to the opening of a bag in sucking process, causing one side of the opening not sucked to a preset position. Then the bag is not surely opened to the preset position for the support rods 401 to extend in the bag to expand the bag correctly for bagging products and a storing plate together.

In addition, the known conventional machine uses bags of heat shrinking property, with no shrinking elasticity, so a hot air blower has to be used to blow hot air toward the bag bagging cartons and a storing plate together to let the bag shrink tightly around them. Thus, hot air blowing adds one more process in the bagging operation, with expenditure for a hot air blower increasing equipment cost. So a kind of cool-shrinking film bags has begun to be used in bagging instead of heat-shrinking bags, which are not easy to break or tear if expanded to a preset maximum size for bagging products and a storing plate together. And after cooled it shrinks to a preset small size to tightly surround the products and the storing plate together, with no need of a hot air blower.

But the known conventional bagging machine is impossible to support a bag expanded by the support rods 401 of the supporting device 40, as cool shrinking bags have elasticity to slide off the support rods 401. So the known conventional bagging machine can only use heat-shrinking bags, lowering largely its added value.

SUMMARY OF THE INVENTION

The objective of the invention is to offer an automatic bagging machine using cool-shrinking film, which includes mainly a bag conveying device, a bag sealing device, a bag sucking device, and a bag supporting device installed on the machine body. The bag conveying device sends bags connected continually to the bag sucking device to suck and stick to a lower opening of each bag to open it for a first stage. Then the four corners of the opening of the bag are respectively compressed on an air sucker by operation of position air pressure cylinders beside each air sucker. Then the bag is expanded out to a preset medium size, not falling down during expanding process. Then the bag supporting device continually sends out a certain length of the bag to be positioned in the bag supporting device, which then expands the bag again to a preset maximum size. The bag together with the bag supporting device are lowered down by elevating frames to release the bag to cover and surround products (or cartons) together with the storing plate. After the bag is completely set free by the bag supporting device, then the lower opening is closed up to tightly cover and surround the products and the storing plate together. The automatic bagging machine can surely bag products and a storing plate together every round of bagging process.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
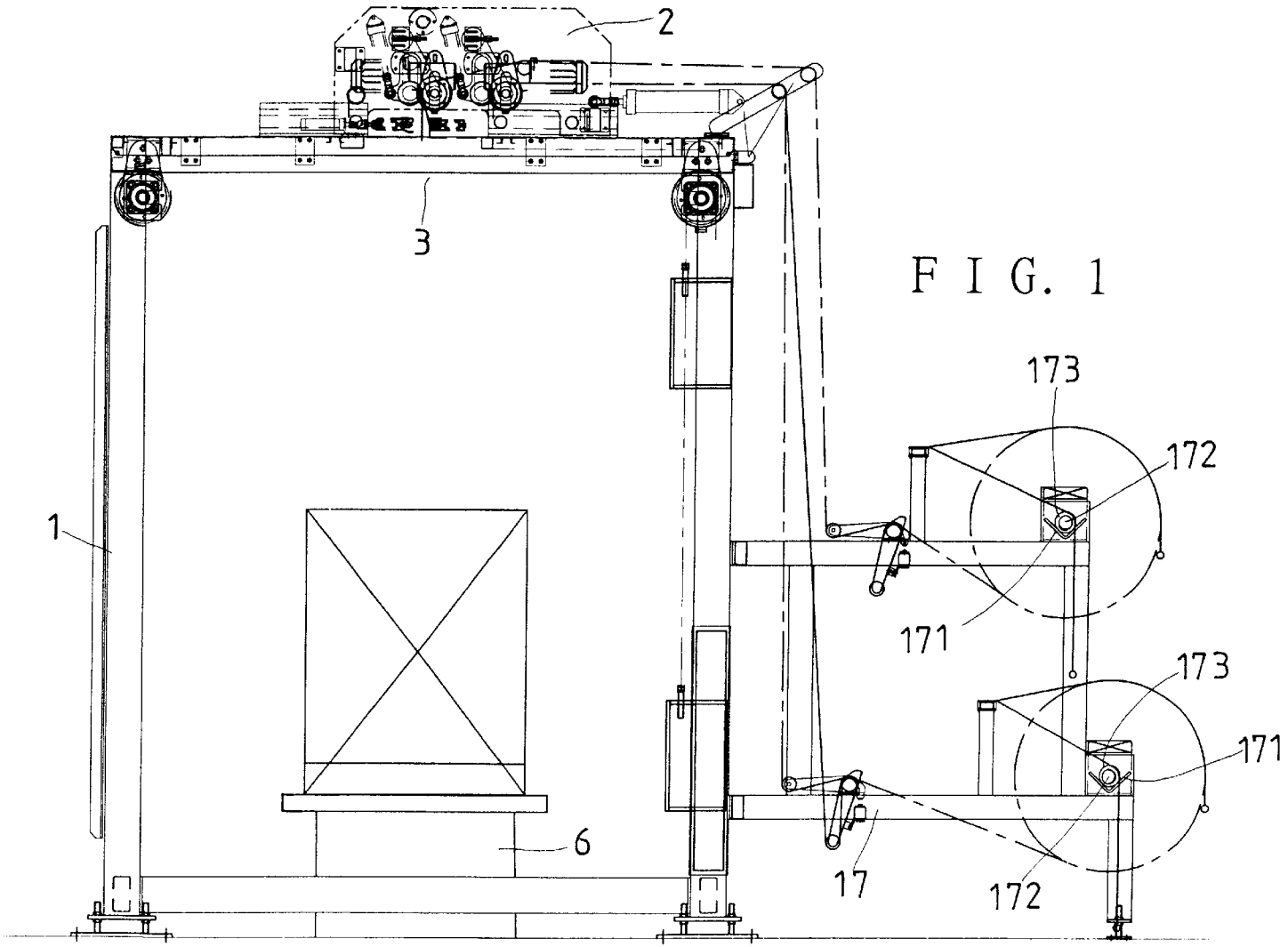
FIG. 1 is a simple front view of an automatic bagging machine not including a bag sucking device or a bag supporting device of the present invention.

A preferred embodiment of an automatic bagging machine using cool-shrinking film of the present invention, as shown in 1 and 2, includes a machine body 1, a bag conveying device 2, a bag sealing device 3, a bag sucking device 4, and a bag supporting device 5 as main components combined together.

The machine body 1 has two material stands 17 spaced apart at one side, and the material stand 17 has a V-shaped base 171 fixed on an outer end of an upper surface. A shaft 172 for winding continual cool-shrinking bags having two ends placed on the V-shaped base 171 via a bearing 173 to let bags conveyed out by the bag conveying device without a possible accident of a hand or a corner of clothing of workers being wound in the conveying device.

Figure 3:
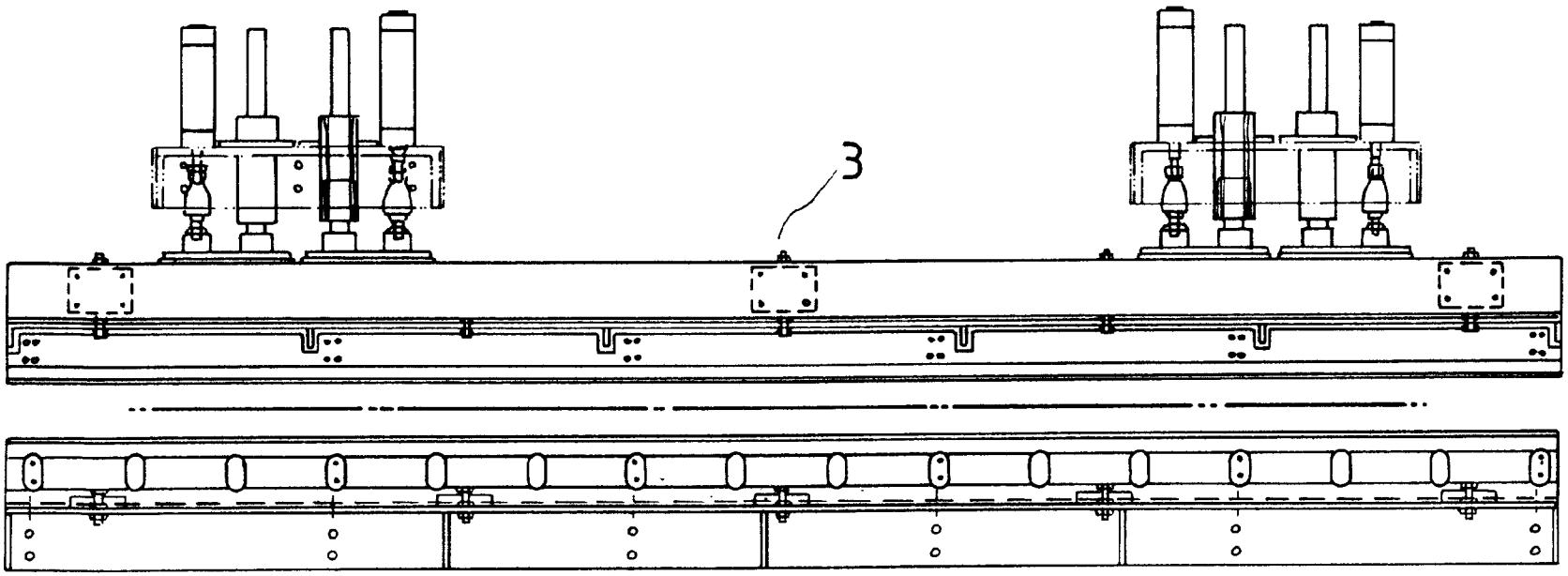
FIG. 3 is an upper view of the bag sealing device of the present invention.
Figure 4:
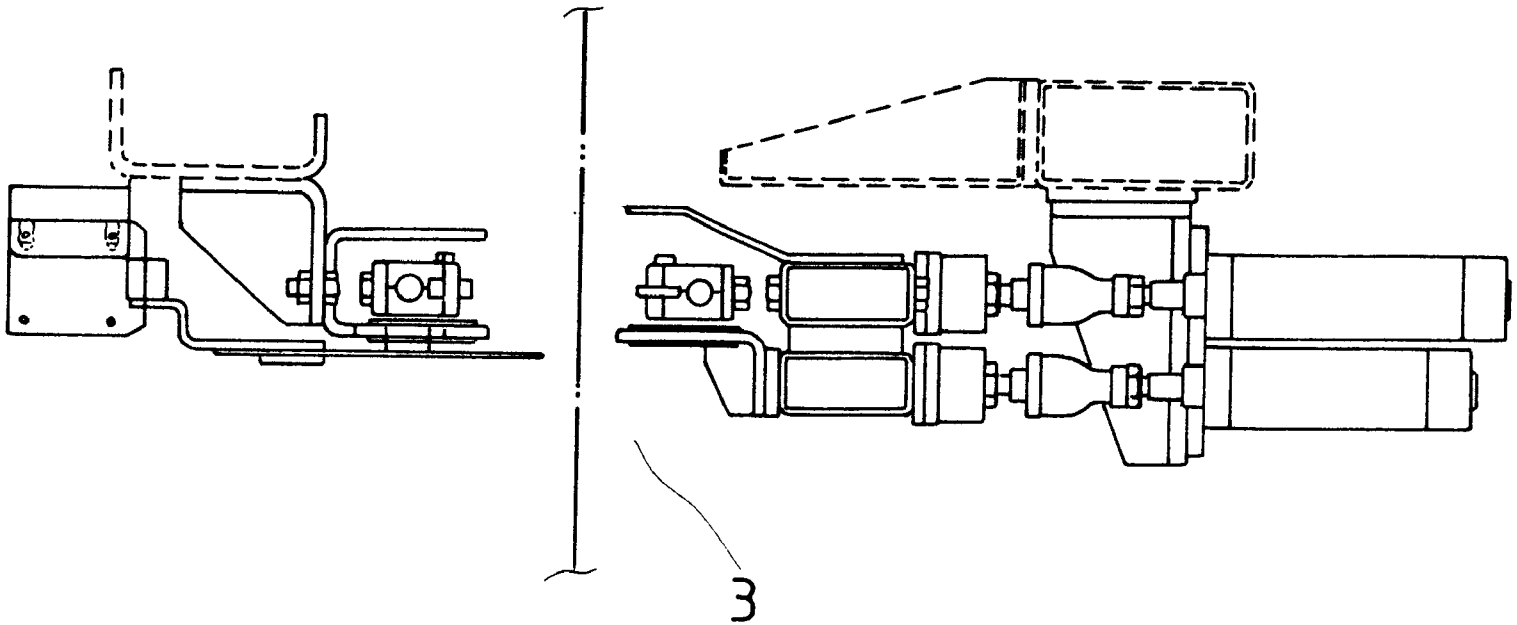
FIG. 4 is a side view of the bag sealing device of the present invention.

The bag conveying device 2 and the bag sealing device 3 are fixed on the top of the machine body 1, sending out cool-shrinking bags one by one in due time and cut off as shown in FIGS. 3 and 4. Further, a transporting unit 6 is provided to transverse under the machine body 1 for conveying products (or cartons) together with a storing plate in and out of the machine body 1. The bag conveying device 2, the bag sealing device 3 and the transporting unit 6 have almost the same structure and function as those in the known conventional bagging machine not included in the present invention, not described in the detailed description or in the figures. Mainly, the bag sucking device 4 and the bag supporting device 5 are improved in the invention.

Figure 5:
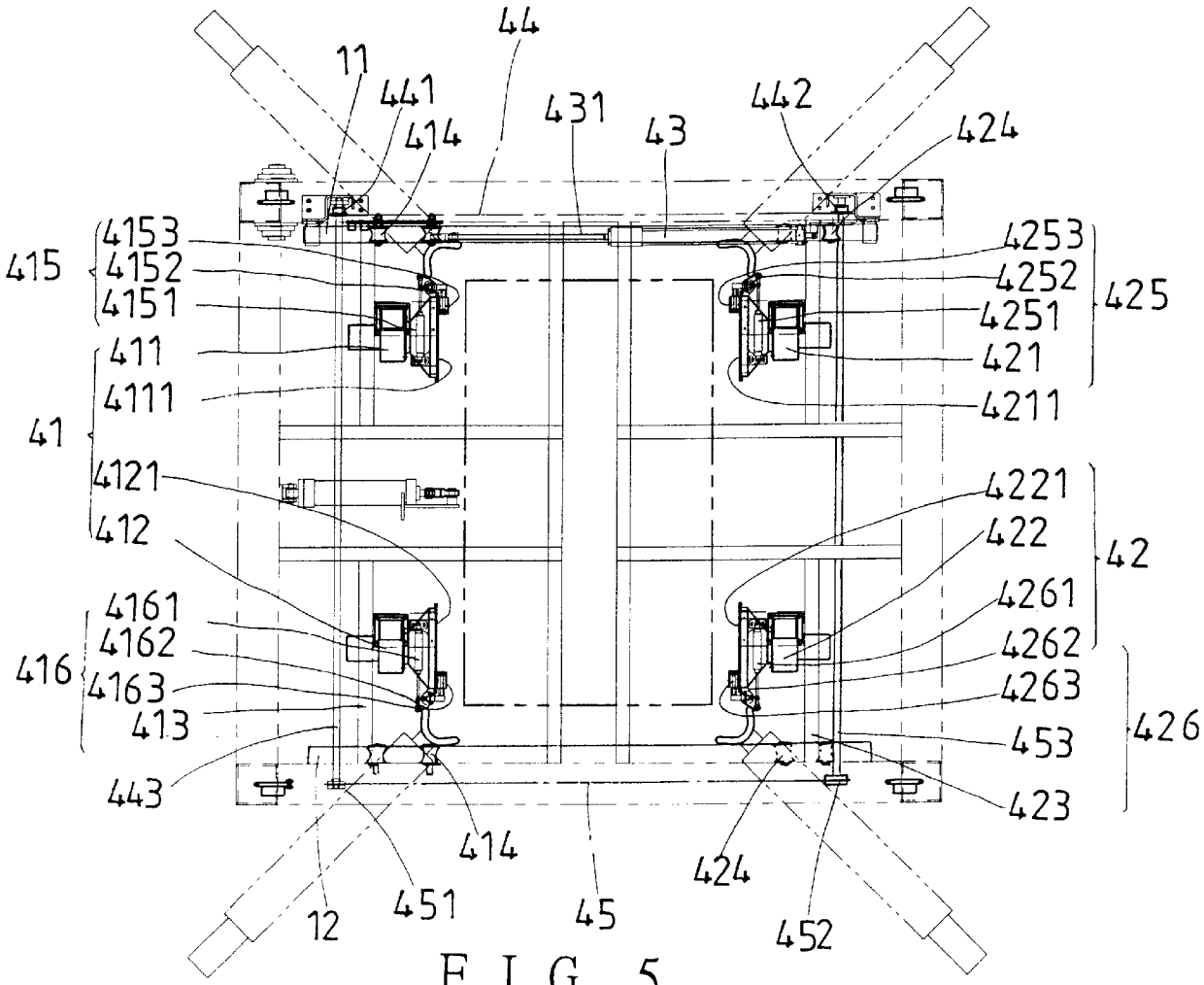
FIG. 5 is an tipper view of the bag sticking device of the present invention.
Figure 6:
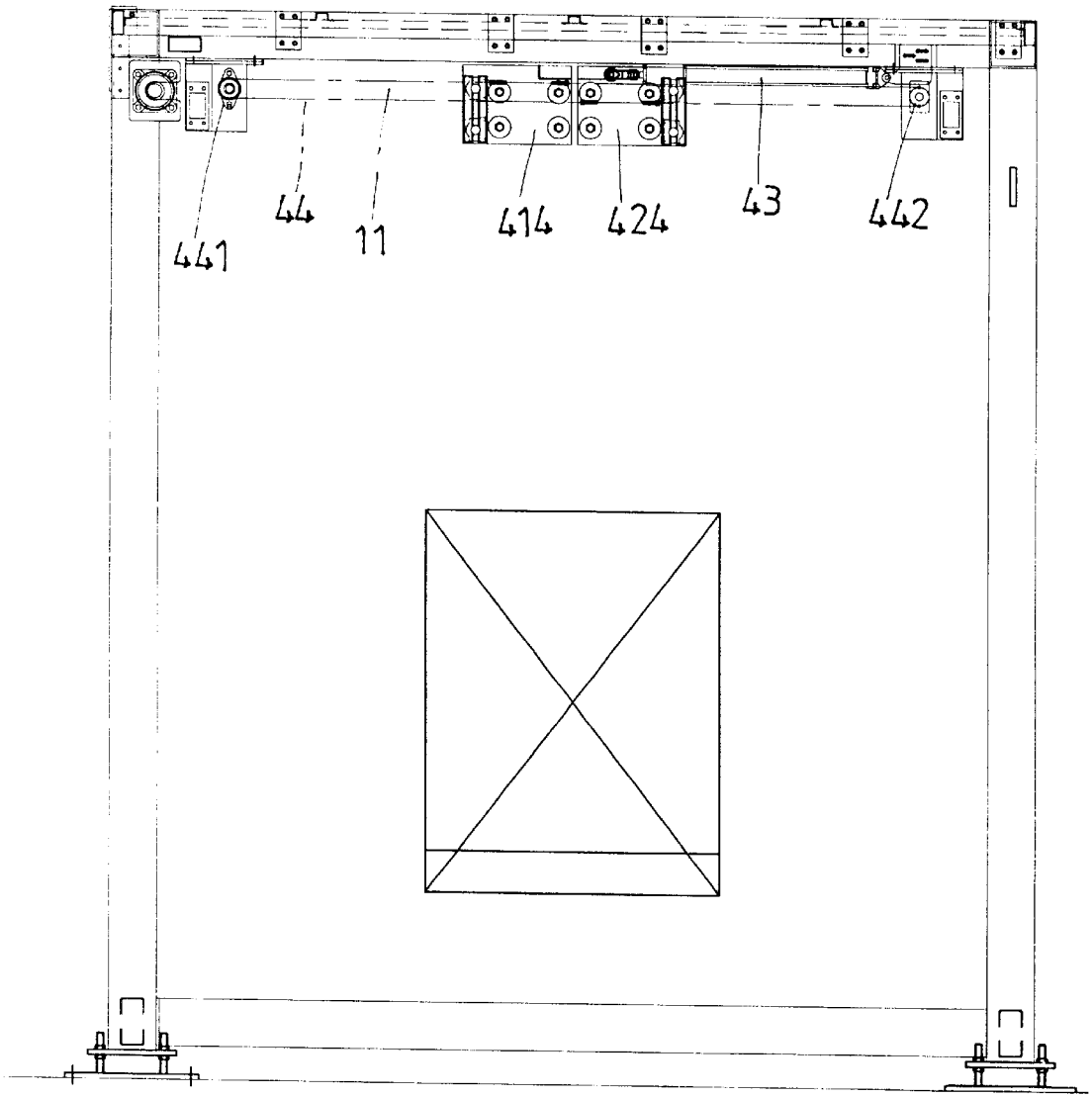
FIG. 6 is a side view of chains of the bag sucking device in the connected condition of the present invention.

The bag sucking device 4 shown in FIG. 5 is positioned in the machine body 1 below an outlet of the bag conveying device 2 and the bag sealing device 3, having a left and a right sucking unit 41 and 42 of the same structure. The left bag sucking unit 41 has a first air sucker 411 and a second air sucker 412, and so does the right bag sucking unit 42 a first air sucker 421 and a second air sticker 422. The first and the second air suckers 411 412, 421, 422 of both the bag sucking units 41 and 42 are respectively laid on slide rods 413 and 423, to let the first and the second bag sucking unit 41 and 42 located opposite to each other. Further two roller units 414, 424 are fixed with the two slide rods 413, 423 as shown in FIG. 6, permitting the left and the right bag sucking unit 41, and 42 positioned astride on two guide rods 11, 12 at two opposite sides of the top surface of the machine body 1. Then the roller unit 414 at one end of the slide rod 413 of the left bag sucking unit 41 is firmly connected to an output piston rod 41 of a pull air pressure cylinder 43 fixed on the machine body 1. Two ends of the slide rod 413 are respectively connected firmly with a chain 44, 45, which extends around chain wheels 441, 451 set in the machine body 1, and then connected firmly to the roller unit 424 of the right bag sucking unit 42. The two chains 44, 45 also pass the roller unit 424 and then extend around chain wheels 442, 452 fixed on the other side of the machine body 1, and then fixed with the other side of the roller unit 414 at two ends of the left bag sucking unit 41. The chain wheels 441, 451, 442, 452 at two opposite sides of the machine body 1 have respectively a shaft 443, 453 connected between each pair of them so as to move the left and the right bag sucking unit 41, 42 nearer to each other or farther away from each other on the guide rods 11. 12. when the pull air pressure cylinder 43 operates the first and the second air sucker 411 and 412, 421 and 422 are respectively positioned around the slide rods 413. 423 spaced apart with a preset distance. Those air stickers 411, 412, 421, 422 are connected to sucking pumps, shaped rectangular, respectively connected to a sucking drum 4111, 4121, 4211. 4221 provided with a plurality of sucking holes in its surface to supply strong sucking force and comparatively big sucking dimensions. Air pressure cylinders 4151, 4161, 4251, 4261 of the position air pressure cylinders 415, 416, 425, 426 are fixed behind the sucking drums 4111, 4121, 4211, 4221, having piston rods, whose ends are pivotally connected to swaying arms 4152, 4162, 4252, 4262. The other ends of the swaying arms 4152, 4162, 4252, 4262 are firmly connected to pressing rods 4153, 4163, 4253, 4263 to move the same rods 4153, 4163. 4253, 4263 sway inward when die air pressure cylinders 4151, 4161, 4251, 4262 operate.

Figure 2:
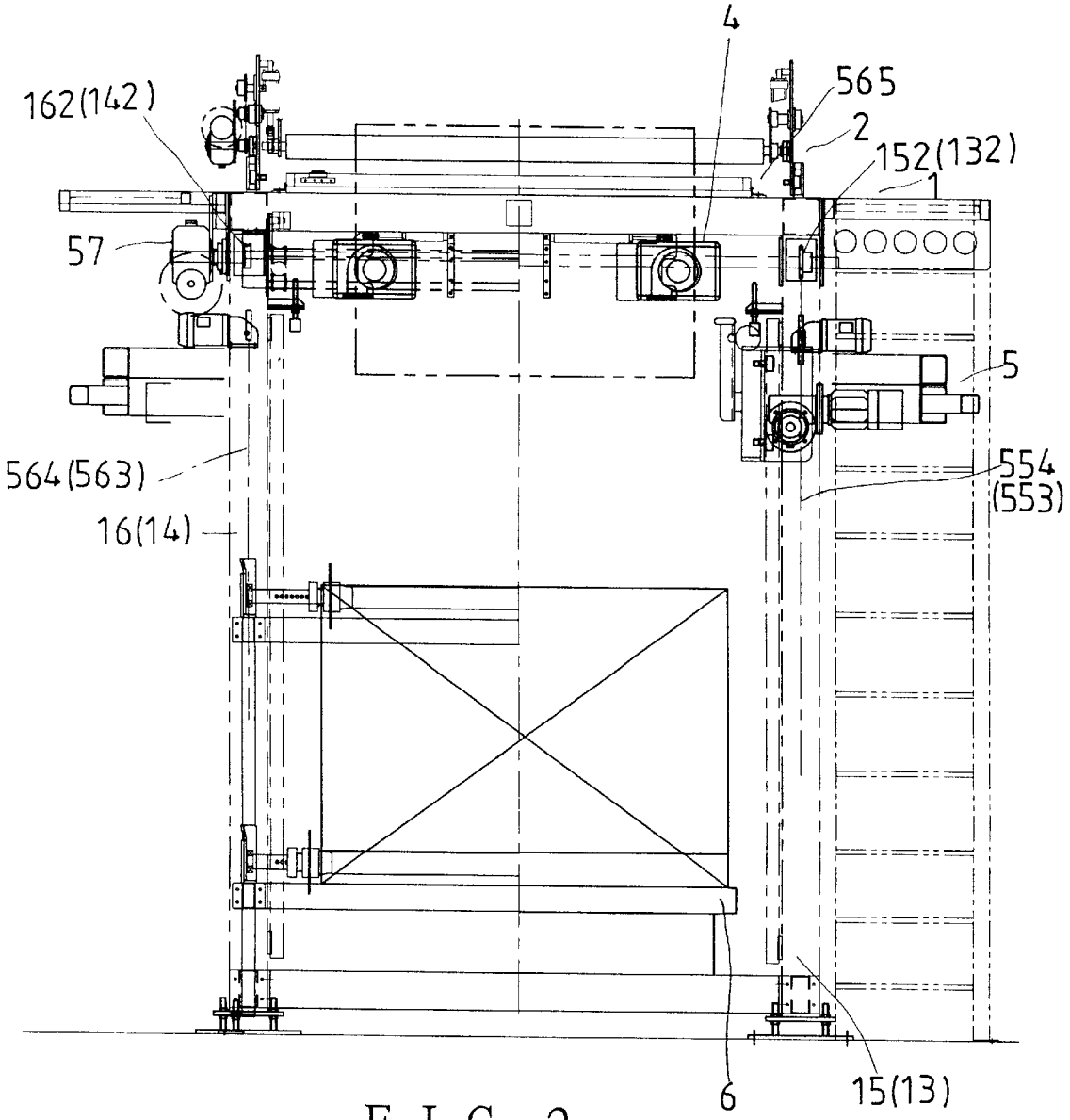
FIG. 2 is a simplified front view of the automatic bagging machine not including a bag sucking device or a bag sealing device of the present invention.
Figure 7:
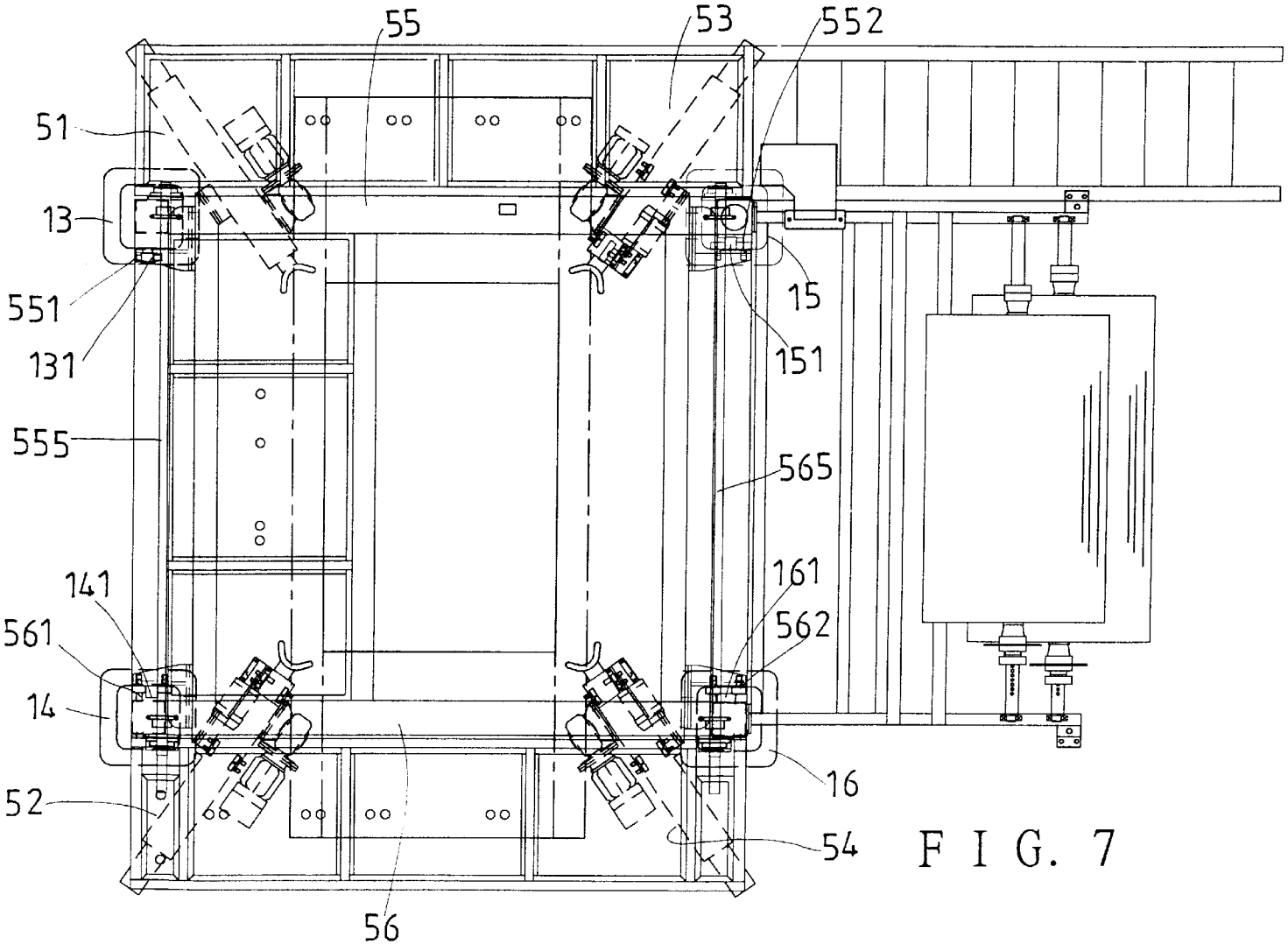
FIG. 7 is an upper view of the bag supporting device of the present invention.

The bag supporting device 5, referring also to FIGS. 2 and 7, includes a left first, a left second, a right first and a right second bag support operating unit 51 and 52, 53 and 54, and two elevating frames 55, 56 for fixing the four bag support operating units 51, 52, 53 and 54 thereon. The four bag support operating units are respectively located at four corners of the machine body 1, extending toward the center of the machine body 1. The two elevating frames 55, 56 have slide bases 551 and 552, 561 and 562 at two ends and riding on rails 131, 141, 151, 161 inside hollow support frames 13, 14, 15, 16 located at four corners of the machine body 1. Further, the slide bases 551, 552, 561, 562 are firmly connected to chains 553, 554, 563, 564 on an upper side, which extend around chain wheels 132, 142. 152, 162 on the support frames 13, 14, 15, 16 and then go down into the support frames 13. 14. 15. 16 to connect firmly with weights (not shown in Figures). The chain wheels 132 and 142, 152 and 162 are connected with a shalt rod 555. 565 for each pair of them. The shaft rod 555 may extend out of the machine body 1 to connect with a power source 57 to move the elevating frames 55, 56 and the four support operating units 51, 52, 53, and 54 up and down synchronously.

Figure 8:
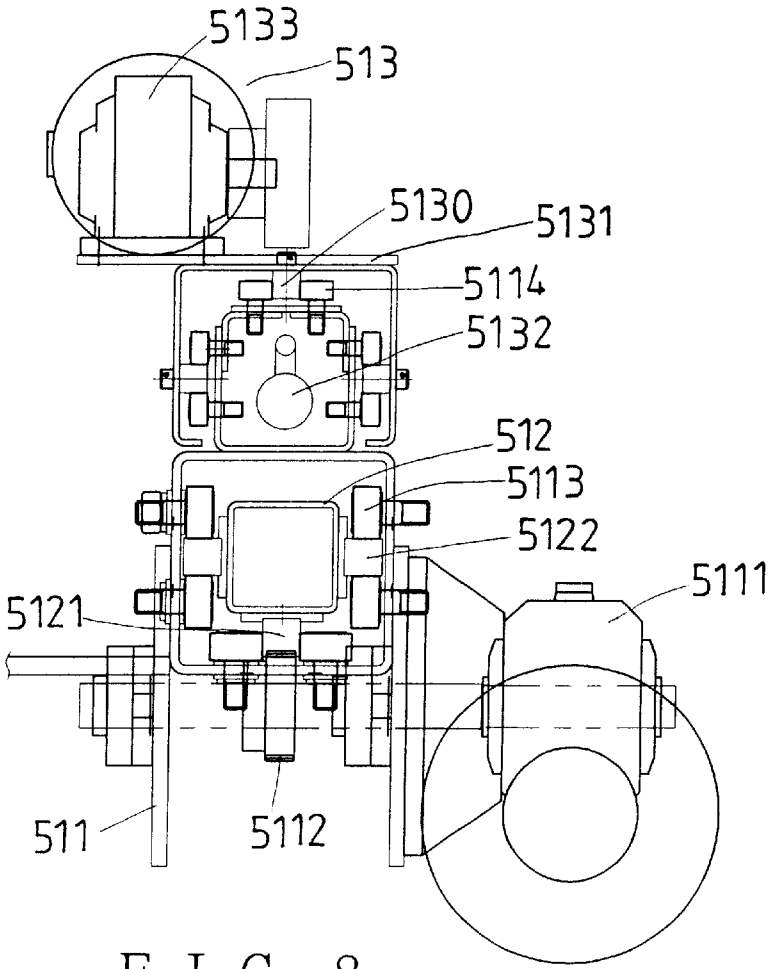
FIG. 8 is a front view of a bag support operation unit of the bag supporting device of the present invention.
Figure 9:
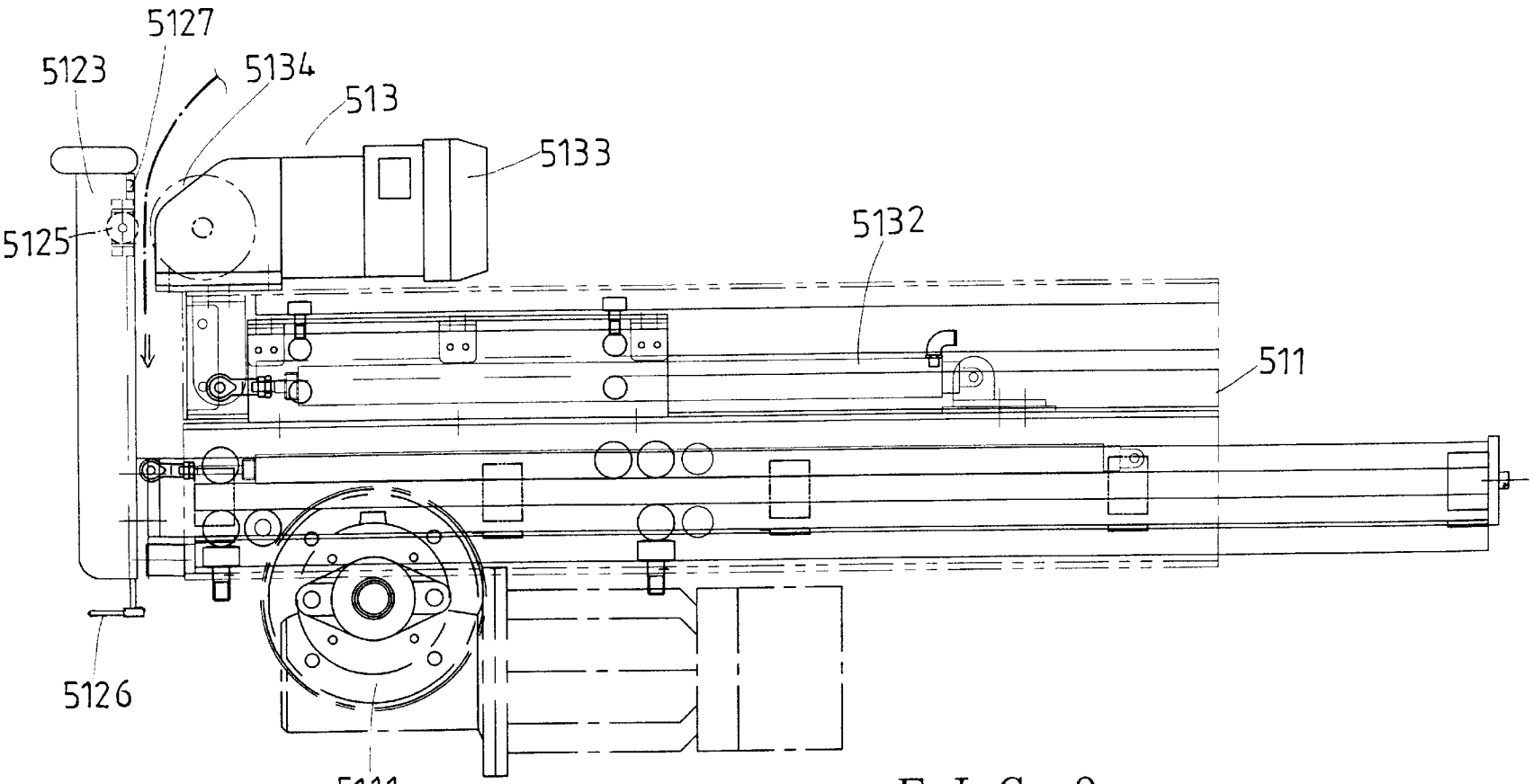
FIG. 9 is a side view of the bag support operation unit of the bag supporting device of the present invention.
Figure 10:
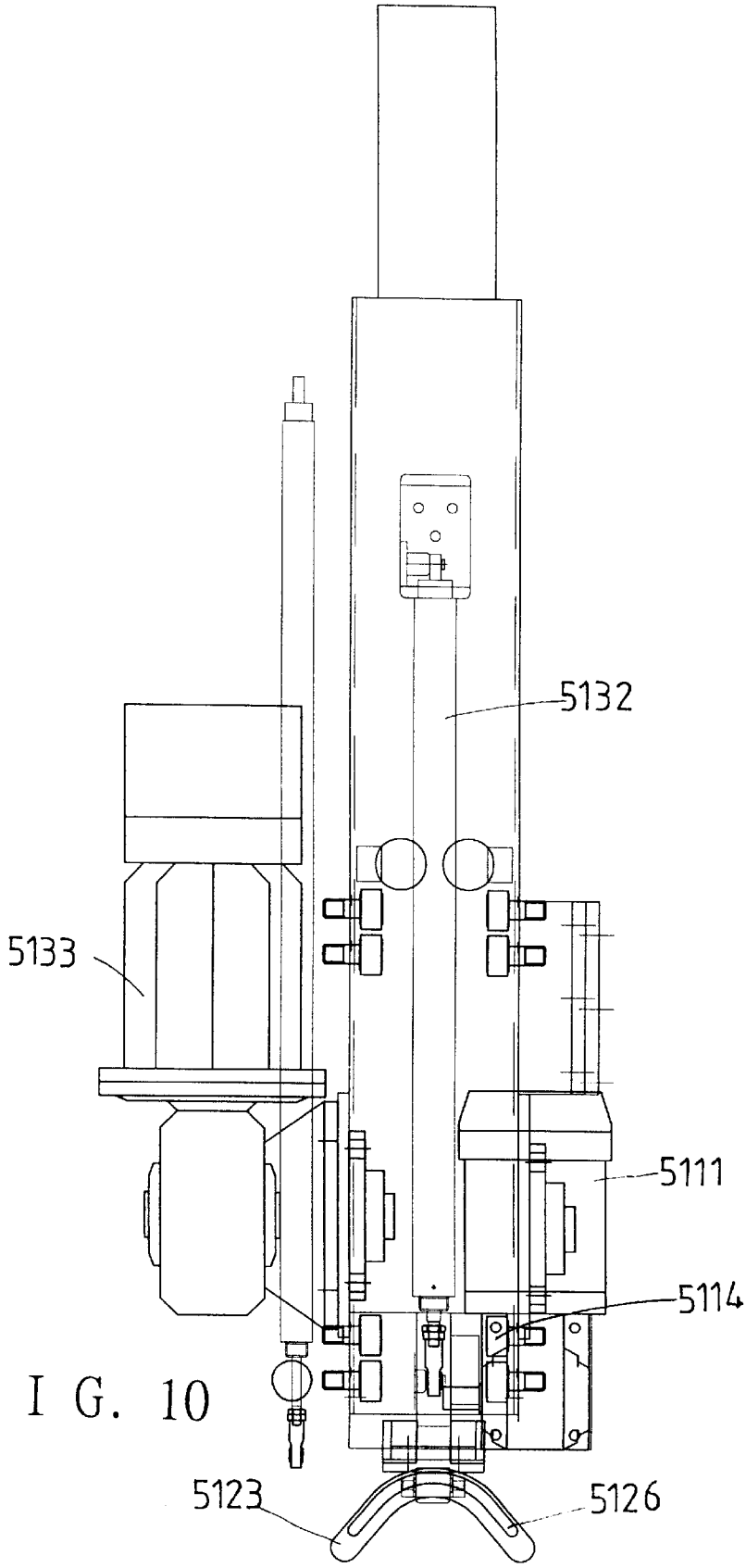
FIG. 10 is an upper view of the bag support operation unit of the bag supporting device of the present invention.

The left first, the left second, the right first and the right second support operating units 51, 52, 53 and 54 respectively consist of a base and a bag closing unit. All bag closing unit is of the same structure, so for example only the left first support operating unit 51 is described here. As shown in FIGS. 8, 9 and 10, the base 511 of the left first support operating unit 51 has one end fixed with one end of the elevating frame 55, and has the other end fixed with a motor 5111. The output shaft of the motor 5111 extends in the base 511, having a transmitting gear 5112 fixed thereon, and the gear 5112 engages a rack 5121 on a bottom of the extension arm 512. A rail 5122 is respectively positioned a t two sides of the extension arm 512 and rests on the guide wheel 5113 in the base 511, so the extension arm 512 extends out or retreats in when the motor 5111 rotates the transmitting gear 5112.

Figure 11:
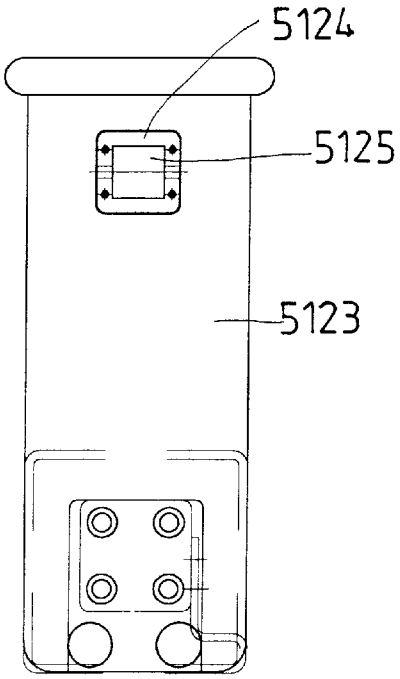
FIG. 11 is a front view of a support plate for operating to support a bag of the present invention.

Further, a vertical supporting plate 5123 is fixed in a front end of the extension arm 512, which has a through hole 5124 in an intermediate portion near an upper end, also referring to FIG. 11, a rolling shaft 5125 pivotally fitted in the through hole 5124, and a sensor 5126 fixed on a lower end to stop at once the machine when the sensor 5126 senses out an obstacle coming below. Another sensor 5127 is fixed above the supporting plate 5123 to sense if a cool-shrinking bag moves inside the support plate or not and stops the machine at once if the bar 7 does still not move inside the supporting plate or the bag 7 is broken. Plural guide wheels 5114 are fixed on an upper side of the base 511, and a rail 5130 of the bag close operating unit 513 is fixed between a pair of the guide wheels 5114, and the operating air pressure cylinder 5132 fixed on the base 511. The other side of an operating air pressure cylinder 5132 is fixed with the slide base 5131, and a bag closing motor 5133 fixed on the slide base 5131, having its output shaft fixed with a compress wheel 5134 to compress the rolling shaft 5125 of the supporting plate 5123 when the operating air pressure cylinder 5132 pushes out its piston rod to move out the slide base 5131 and the bag closing motor 5133.

Figure 12:
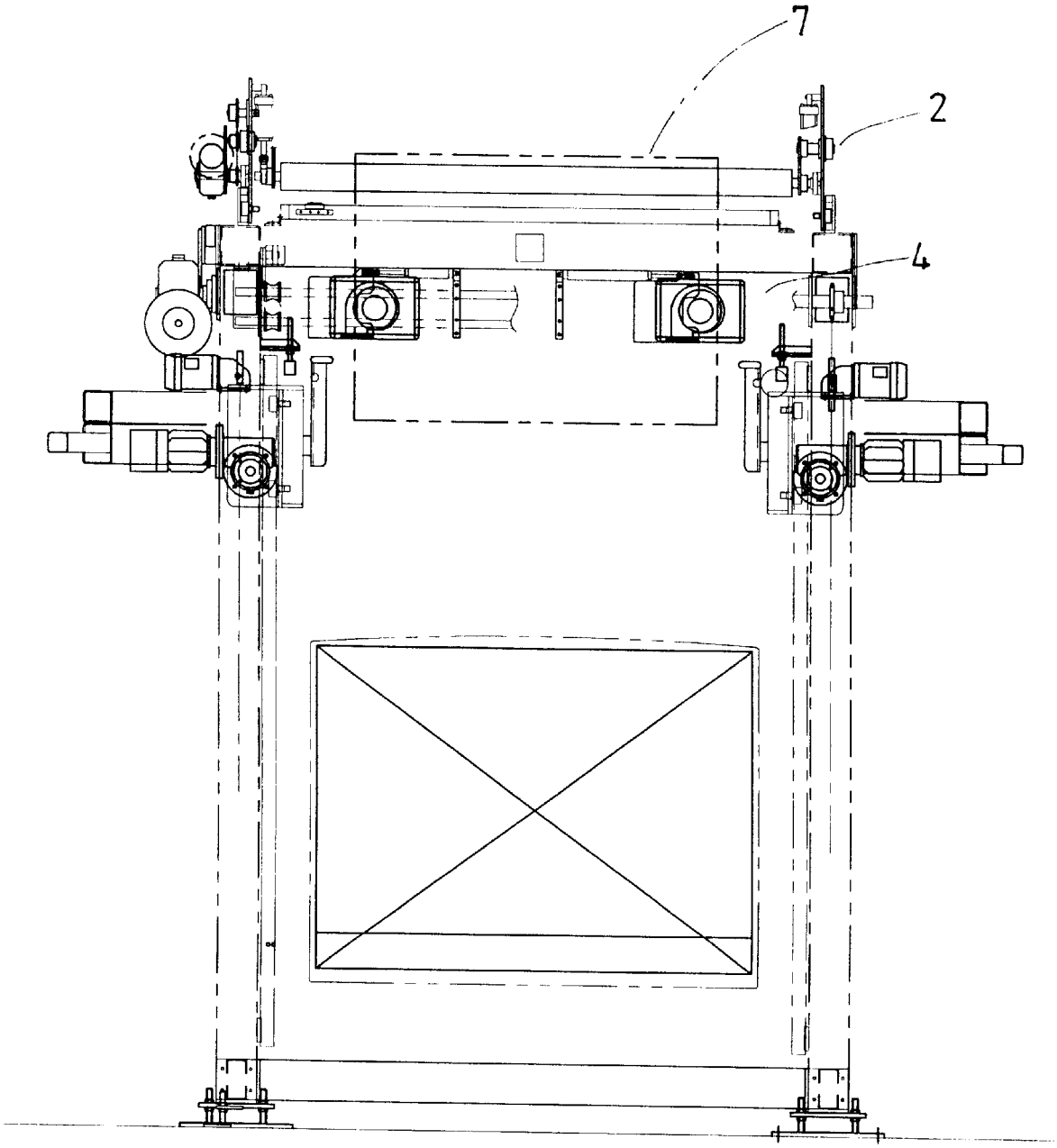
FIG. 12 is a front view of a cool-shrinking film bag sent out in the bagging machine of the present invention.
Figure 13:
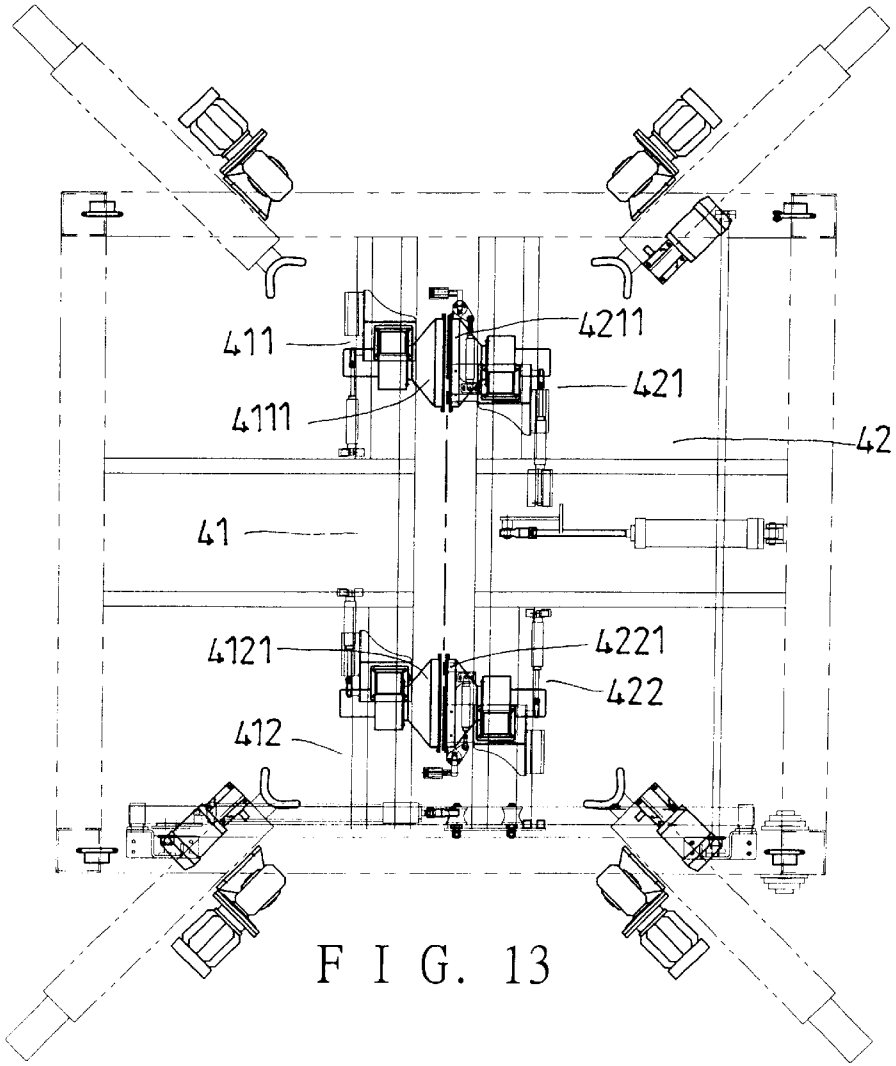
FIG. 13 is an upper view of the bag sucking device in operating condition of the present invention.

Next, operation of the bagging machine is to be described, with reference to FIG. 12. When a certain length of continual cool-shrinking bags 7 is conveyed out by the bag conveying device 2, the bottom opening of a bag 7 is located between the left and the right sucking units 41, 42 of the bag sucking device 4, and then the piston rod 431 of the pull air pressure cylinder 43 moves back. Then the left and the right sucking units 41, 42 moves nearer to each other to contact the two sides of the bag 7, as shown in FIG. 13 and the second enclosed picture. At this time, all the air suckers 411, 412, 421, 422 and the left and the right sucking unit 41, 42 begin to operate to let the sucking drums 4111, 4121, 4211, 4221 suck and stick to the bag body 7.

Figure 14:
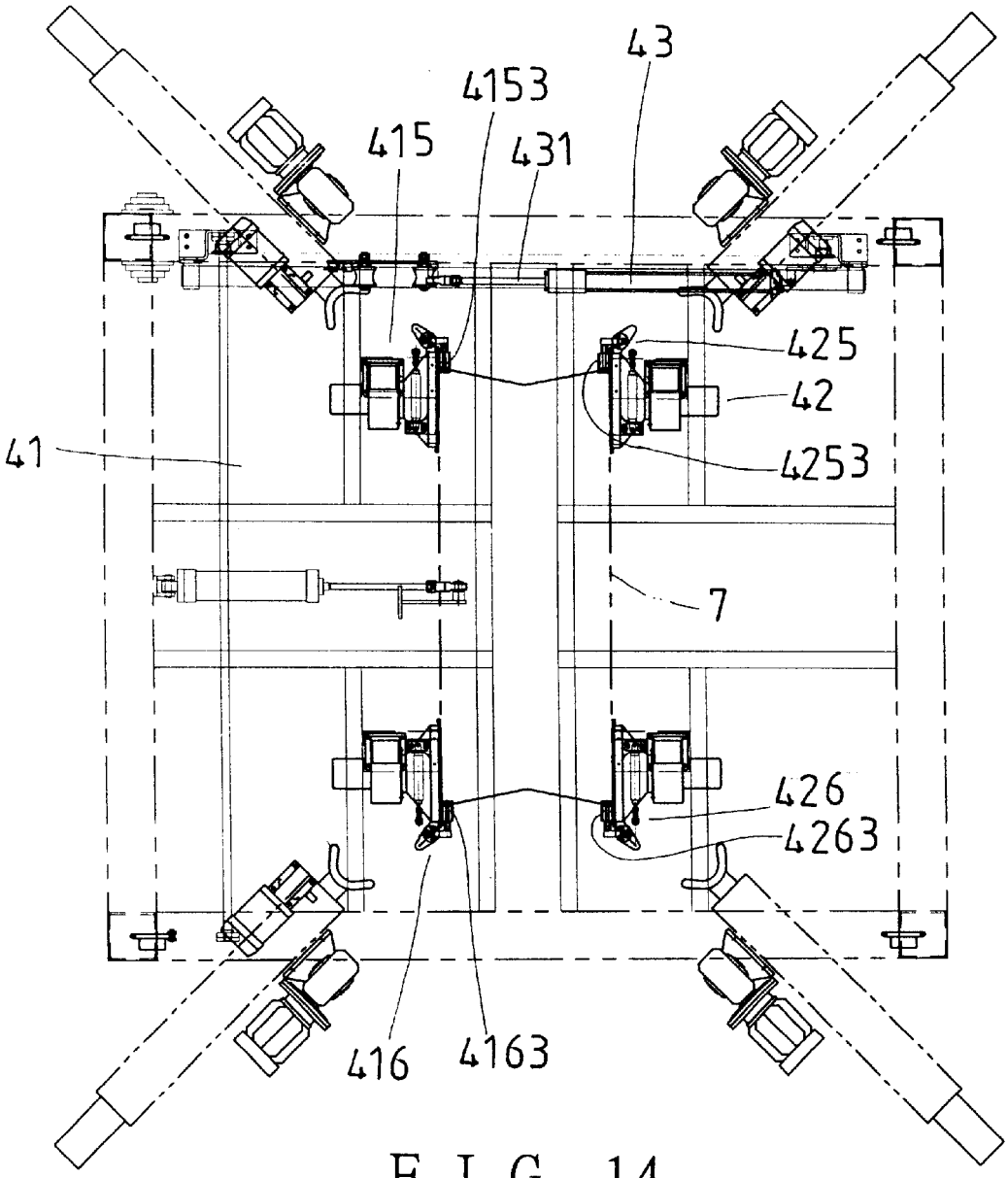
FIG. 14 an upper view of the bag sucking device and its fixing air pressure cylinder in operating condition of the present invention.
Figure 15:
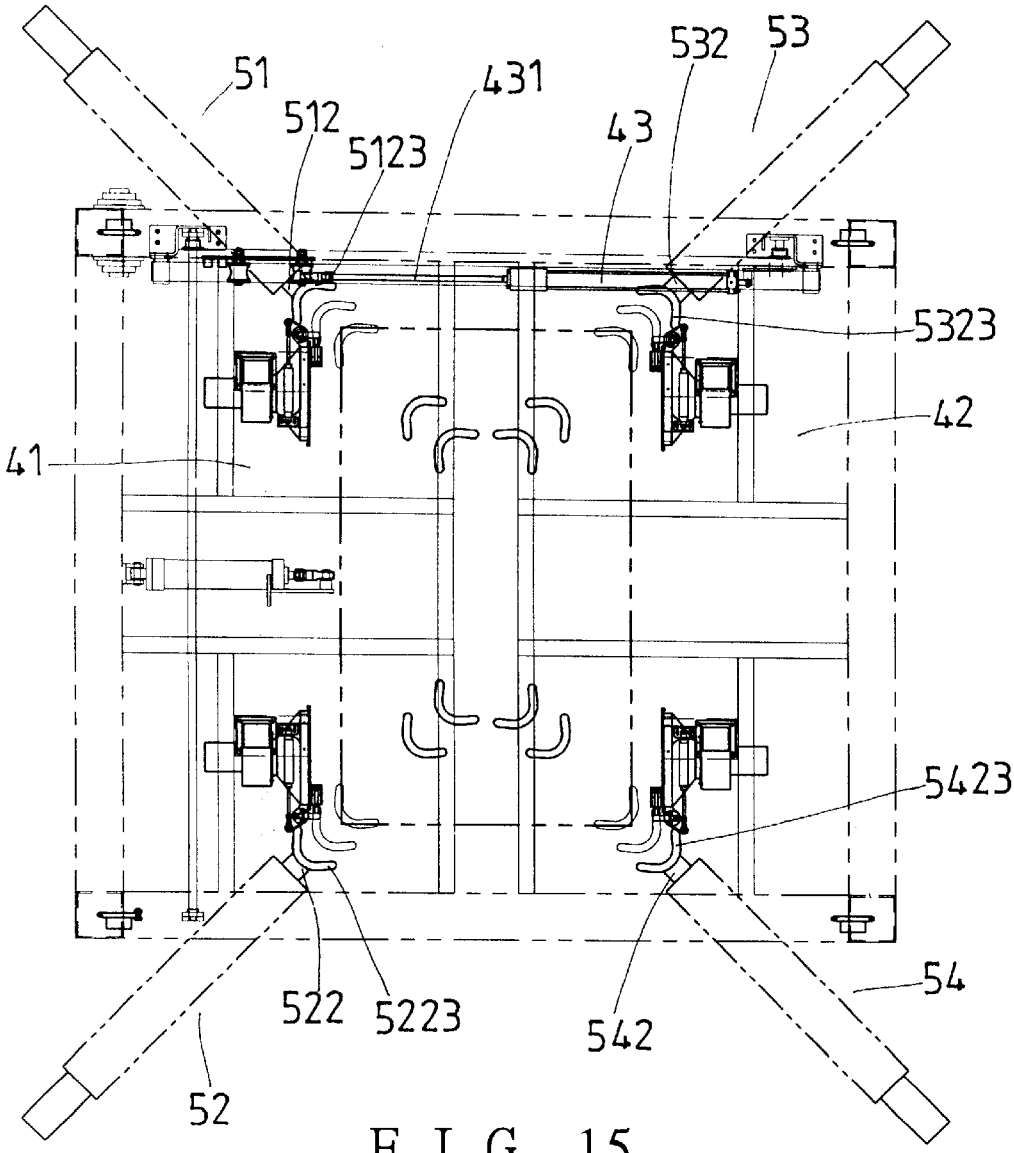
FIG. 15 is an upper view of the bag supporting device in operating condition of the present invention.
Figure 16:
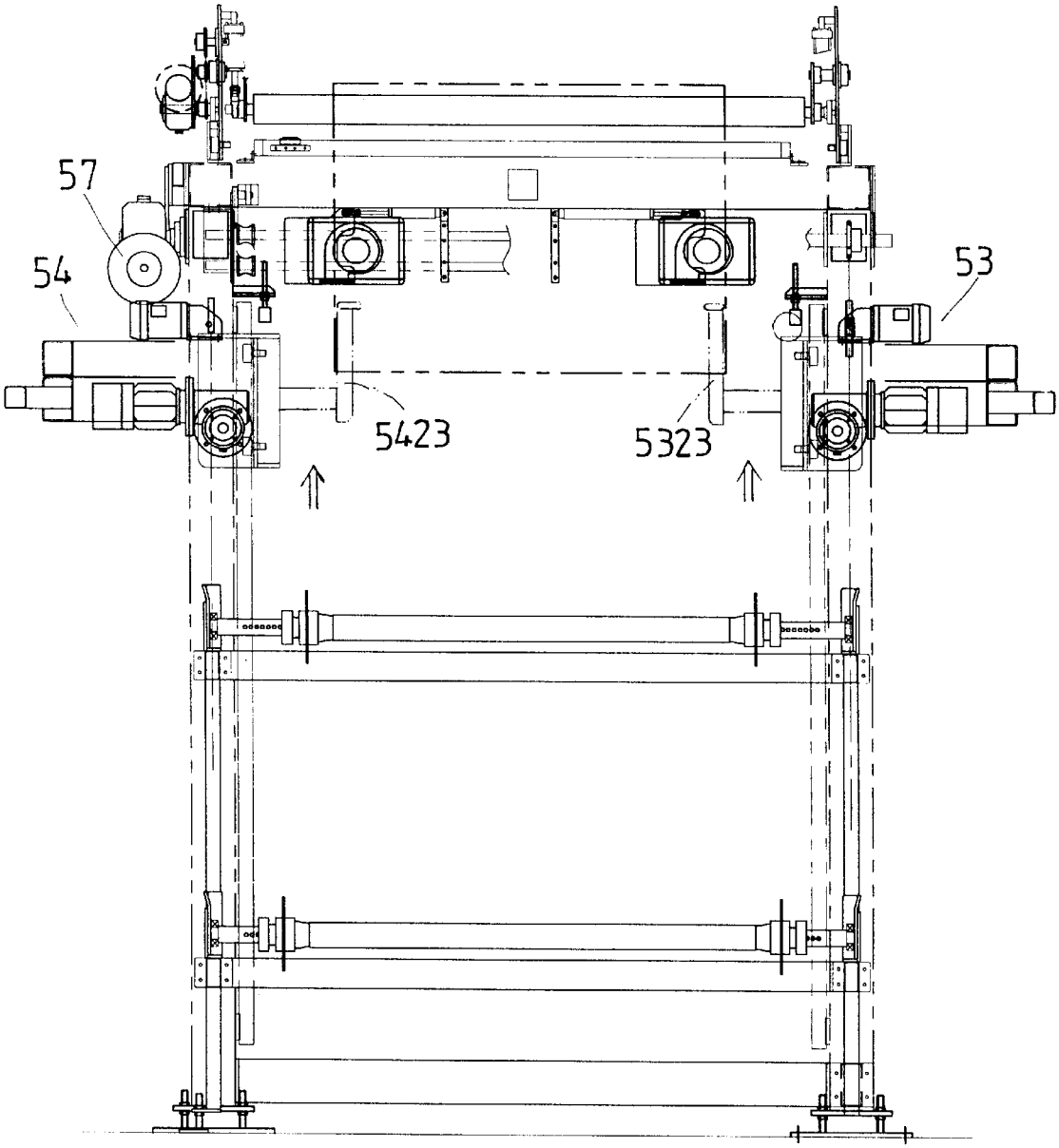
FIG. 16 is a front view of the bag supporting device in moving up condition of the present invention.

When the air stickers 411, 412, 421, 422 of the left and the right sucking units 41, 42 stick to the two sides of the bag 7, the piston rod 431 of the pull air pressure cylinder 43 is moved a little forward, forcing the left and the right bag sticking unit 41, 42 begin to move farther outward for some degree, as shown in FIG. 14 and the third enclosed photo to open a little the opening of the bag 7. Then the air pressure cylinders 4151, 4161, 4251, 4261 of the position air pressure cylinder units 415, 416, 425, 426 at one side of all the air suckers moves their piston rods forward to move the swaying arms 4152, 4162, 4252, 4262 together with the pressing rods 4153, 4163, 4253, 4263 pivotally connected to the other ends of the air pressure cylinders 4151, 4161, 4251, 4261 into the sucking drums 4111, 4121, 4211, 4221, compressing at the same time the four corners of the bag 7. Then the pull air pressure cylinder 43 moves its piston rod out to move the left and the right bag sucking units 41, 42 farther away from each other as shown in FIG. 15, forcing the opening of the bag open to a preset size. After that, the bag support operating units 51, 52, 53, 54 of the bag supporting device 5 operate to extend out all the extension arms 512, 522, 532, 542, and then the power source 57 starts to move up the elevating frames 55, 56 together with all the bag support operating units, letting the supporting plates 5123, 5223, 5323, 5423 of the support operating units protrude in the already opened bag 7, as shown in FIG. 16. Then the sensor 5127 may sense if the bag 7 reaches the preset location or not, and then the operating air pressure cylinders of the bag supporting device 5 operate to push forward the bag closing motors and the compress wheels to let the compress wheels compress the body of the bag 7 between the rolling shafts (referring to FIG. 9) on the supporting plates 5123, 5223, 5323 5423 of the extension arms 512. 522, 532. 542. Then the position air pressure cylinder units 415. 416. 425, 426 let free the bag body 7 so far compressed.

Figure 17:
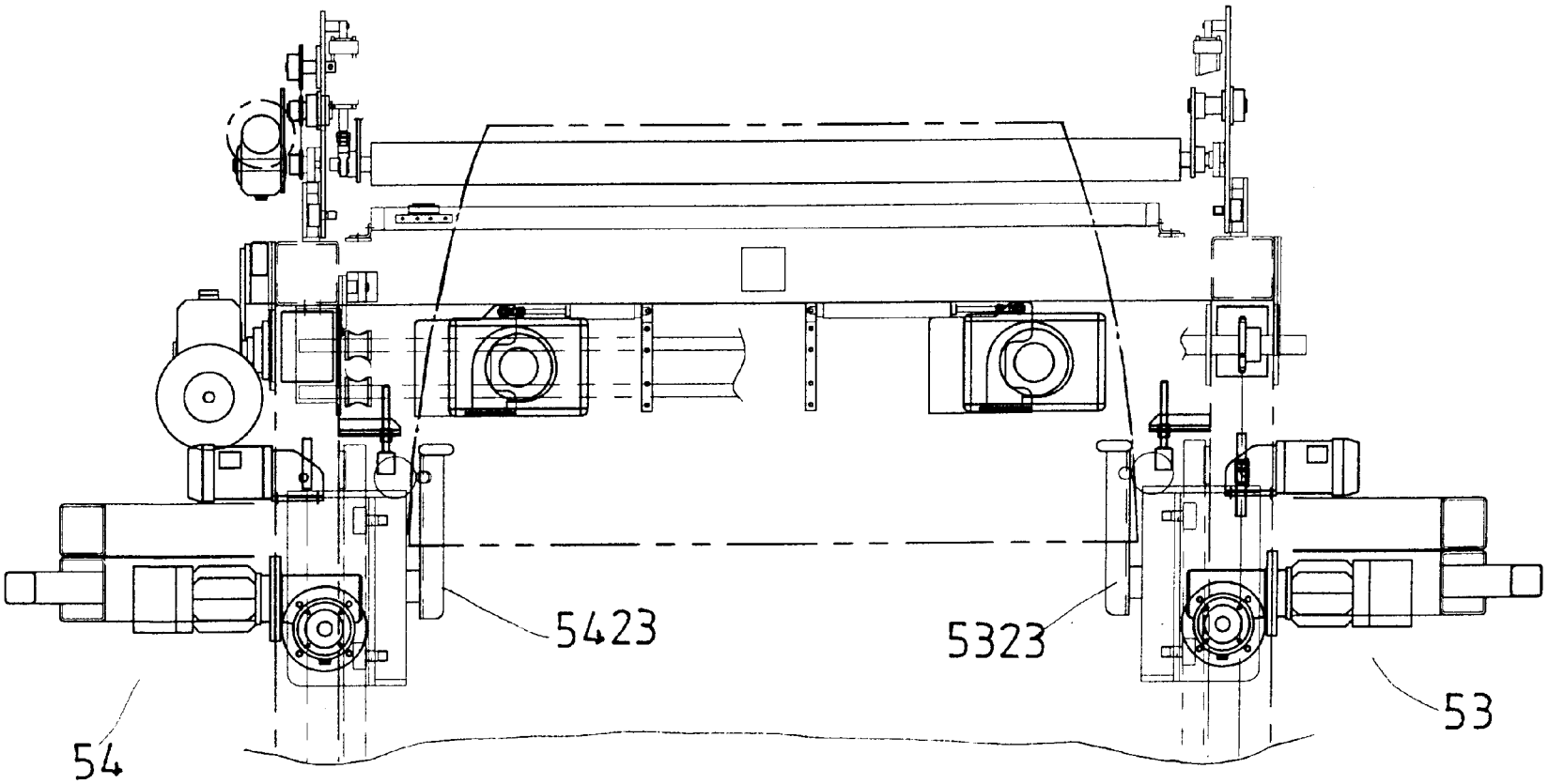
FIG. 17 is an upper view of the bag supporting device in expanding-bag condition of the present invention.

After the bag 7 is pinched between the compressed wheels of the bag support operating units 51., 52, 53, 54 and the rolling shafts, the bag closing motors rotate the compress wheels, and at the same time the bag conveying device 2 operates again to convey out another bag, with the bag 7 wound by the compress wheels to the rear bottom side of the supporting plates 5123, 5223, 5323, 5423. When the preset length of the bag 7 is conveyed out, the bag conveying device 2 and the compress wheels stop at once operation, permitting the compress wheels pulled back, and the bag body 7 is expanded to the maximum size by the supporting plates 5123, 5223, 5323, 5423, as shown in FIG. 17.

Figure 18:
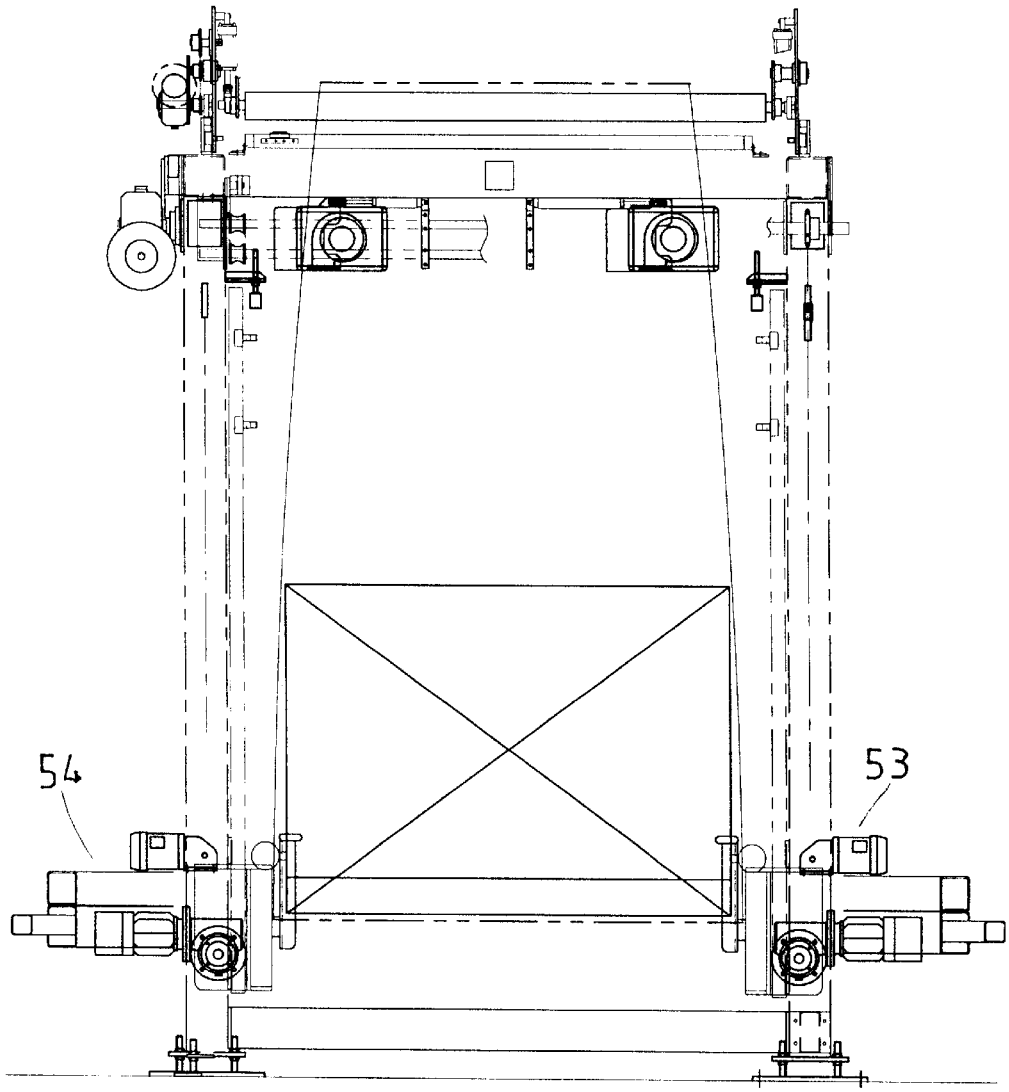
FIG. 18 is side view of the bag supporting device in lowered-down condition of the present invention.
Figure 19:
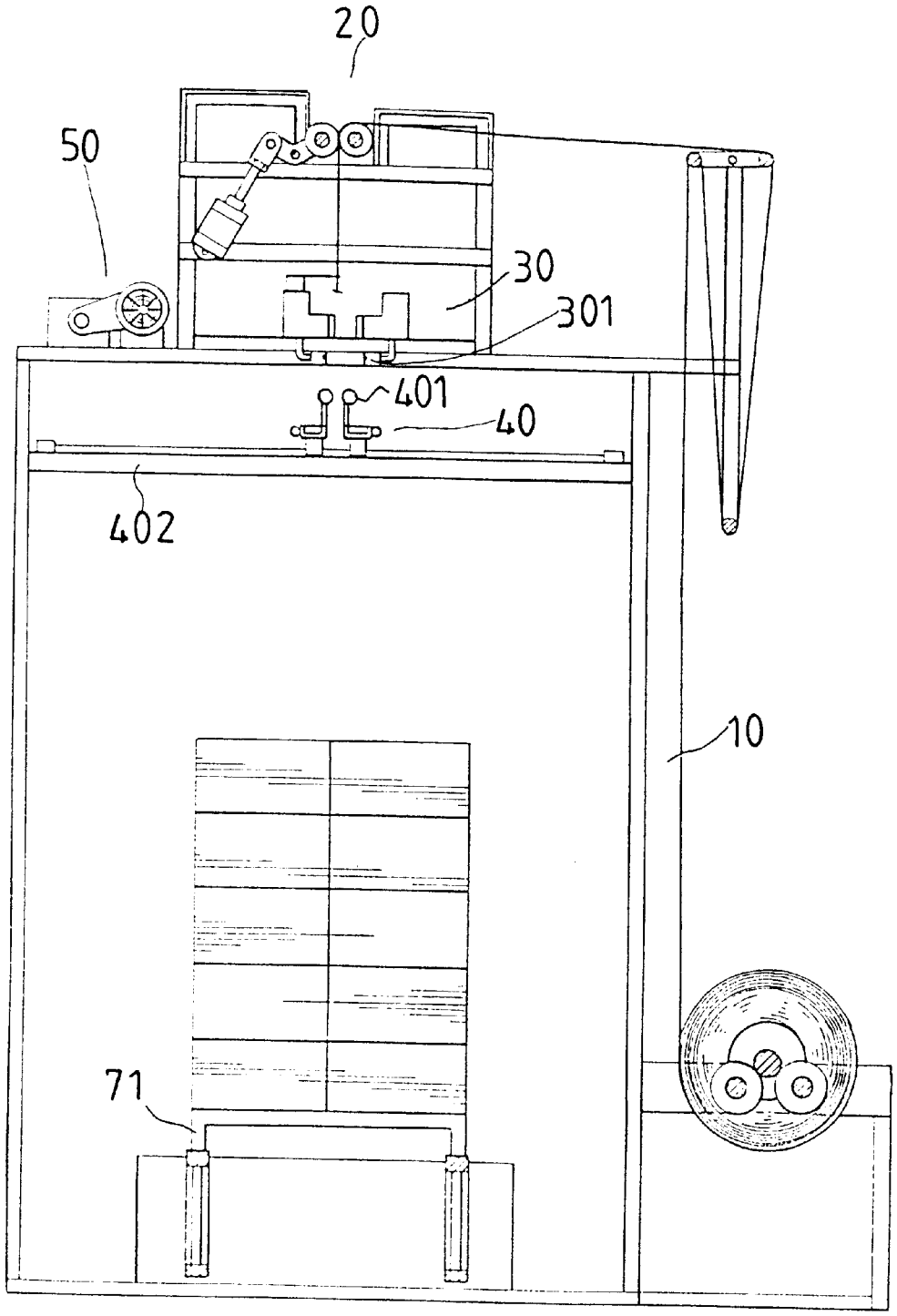
F I G. 19 (PRIOR ART)
FIG. 19 is s front view of a known conventional bagging machine.

Then the power source of the bag supporting device 5 operates again, moving down the elevating frames 55, 56 and the bag support operating units 51, 52, 53, 54, and the bag body 7 gradually separates from the supporting plates 5123, 5223, 5323, 5423, covering the outer sides of the products (or cartons) and the storing plate together sent on the transporting unit 6. Before the bag supporting device 5 descends to the lowest level, the bag sealing device 3 cut the bag 7 off the continual bag coil. Then the compress wheels of the bag support operating units 51, 52, 53, 54 are moved out again and compress the remaining bag body 7 supported by the supporting plates 5123, 5223, 5323, 5423, and the bag supporting device 5 continues to move down as shown in FIG. 18, letting the cut packaged bag 7 completely covers the products and the storing plate until the bag supporting device 5 descends to the lowest level. Then the bottom opening of the package bag 7 automatically separate from the supporting plates 5123, 523, 5323, 5423, shrinking owing to its own elasticity on the bottom of the storing plate totally surrounding tightly the products and the storing plate.

After a bagged products and the storing plate is transported out from the machine body 1 by the transporting device 6, another bunch of products placed on another storing plate is transported in the machine body 1 for bagging next.

The automatic bagging machine of the invention has the following advantages, as can be understood from the aforesaid description.

1. Each air suckers is provided with a sucking drum having a large dimensions to suck and stick to a bag body with a strong force, with the bag body not liable to fall off.
2. Successful percentage of expanding bags is enhanced by the bag sucking device, which has plural position air pressure cylinders to compress four corners of the bag body, without possibility of movement of the bag body in expanding process of the bag body, letting the supporting plates surely move in the bag body.
3. It can apply not only to cool-shrinking film bags but to heat-shrinking film bags, by means of the bag supporting device which has the supporting plates for protruding in a bag to support and gradually to release the bag, with the bag not slide off the supporting plates, elevating the added value of the machine.

What is claimed is:

1. An automatic bagging machine using cool-shrinking film bags comprising a machine body, a bag conveying device, a bag sealing device, a bag sucking device and a bag supporting device combined with said machine body, said bag conveying device and said bag sealing device fixed on an upper side of said machine body for conveying continual cool-shrinking bags down and sealed and cut in due time, further a transporting device provided just below said machine body to transport products together with a storing plate in and out of said machine body; and characterized by, said bag sucking device consisting of a left sucking unit and a right sucking unit of the same structure, said left and said right sucking units having respectively a first and a second air suckers fixed on a slide rod in an opposite position, a roller unit respectively fixed with two ends of said slide rods of said left and said right sucking units and being laid astride on a guide rod provided on the upper side of said machine body, said slide rod of said right sucking unit having one end fixed with an other end of a pull air pressure cylinder fixed on said machine body, said left and said right sucking units moving nearer to each other or farther away from each other on said guide rod by means of chains at the same time; an air pressure cylinder of a position air pressure cylinder unit respectively fixed behind each said air sucker, each said air pressure cylinder having a piston rod with its outer end pivotally connected to a swaying arm pivotally connected to each said air sucker said swaying arm having an other end fixed with a pressing rod, said pressing rod being moved inward when said each air pressure cylinder operates;

said bag supporting device consisting of a left first, a left second, a right first and a right second support operating unit respectively fixed on an elevating frame, each said elevating frame having two ends provided with a slide base on said rails of said machine body, each said elevating frame connected to a power source by means of a chain, said power source moving up and down said elevating frames and said support operating units; said left first, said left second, said right first and said right second support operating unit respectively consisting of a base, an extension arm and a bag close operating unit, each said base fixed on each said elevating frame, a motor fixed at one side of each said base, each said motor extending or retreating each said extension arm in due time, each said extension arm having an other end connected firmly to a vertical supporting plate, each said supporting plate having a through hole in an intermediate portion near an upper side for pivotally connecting a rolling shaft; each said bag close operating unit fixed on an upper side of said each base, said operating air pressure cylinder of each said bag close operating unit fixed on each said base, an other end of each said operating air pressure cylinder connected firmly to each said bag closing motor, a compress wheel fixed with an output shaft of each said bag closing motor, each said compress wheel compressing each said rolling shaft of each said supporting plate of each said extension arm;

said press rods of said position air pressure cylinders compressing for corners of a bag for packaging when said air suckers sucking and sticking to said bag body conveyed out of said bag conveying device, said press rods then expanding outward said bag to keep said bag from falling down in expanding process; said bag supporting device keeping on sending a certain length of said bag and hold it on bottoms of said supporting plates by means of said compress wheels said bag expanded to the maximum size when said extension arms are retreated, and said expanded bag gradually released to cover and surround said products and said storing plate during descending of said bag supporting device.

2. The automatic bagging machine using cool-shrinking film as claimed in claim 1, wherein said bag sucking device further has a chain fixed with one side of said roller unit each at two ends of said slide rod of said left bag sucking unit, said two chains extending around a chain wheel and connected firmly to said roller units at two ends of said right sucking unit, said chains passing through said slide rods, and extending around said chain wheels at an other side of said machine body and then connected respectively to an other side of said roller unit at two ends of said slide rod, each said chain wheel connected firmly with each other with a shaft, said left and said right sucking unit moving nearer to each other or farther away from each other when said pull air pressure cylinder operates.

3. The automatic bagging machine using cool-shrinking film as claimed in claim 1, wherein said air stuckers of said left and said right sucking unit connect respectively with an air drum rectangular and having many air holes in its surface to increase dimensions to suck and stick to a bag.

4. The automatic bagging machine using cool-shrinking film as claimed in claim 1, wherein each said elevating chain of said elevating frames of said bag supporting device has one end fixed on an upper side of said each slide base, said elevating chain extending up to fit around said chain wheel of each said support frame of said machine body and down in each said support frame to connect firmly to a weight, each said chain wheel connected to each other with a shaft, one of said shaft connected firmly to a power source to move said elevating frames up and down in due time.

5. The automatic bagging machine using cool-shrinking film as claimed in claim 1, wherein each said operating motor of said each support operating unit of said bag supporting device has its output shaft connected firmly to a transmitting gear engaging a rack fixed on said extension arm so as to extend out or retreat said extension arm by operation of said operating motor.

6. The automatic bagging machine using cool-shrinking film as claimed in claim 1, wherein a sensor is fixed below each said supporting plate of said each support operating unit sensing if there is any obstacle below said supporting plate, said sensor at once stopping the machine in case of sensing out there is an obstacle.

7. The automatic bagging machine using cool-shrinking film as claimed in claim 1, wherein a sensor is provided above each said supporting plate of said support operating units of said bag supporting device to sense if a bag body surely enters inside said supporting plate or not.

8. The automatic bagging machine using cool-shrinking film as claimed in claim 1, wherein each said extension arm of each said support operating unit of said bag supporting device has a slide base at two sides and laid on said rails inside said base.

9. The automatic bagging machine using cool-shrinking film as claimed in claim 1, wherein each said base of said support operating units of said bag supporting, device has a rail fixed on an tipper side for said slide base of said bag close operating unit to rest on, a bag closing motor fixed on said slide base, and an other end of said output piston rod of said operating air pressure cylinder connected firmly to said slide base.

10. The automatic bagging machine using cool-shrinking film as claimed in claim 1, wherein said material stand at one side of said machine body has two V-shaped supporters on an upper surface to support two ends of a shaft wound with a cool-shrinking bags coil, and each said end fixed around with a bearing.

* * * * *